United States Patent [19]

Miyasaka et al.

[11] Patent Number: 4,818,675

[45] Date of Patent: Apr. 4, 1989

[54] SILVER HALIDE PHOTOGRAPHIC LIGHT SENSITIVE MATERIAL WITH IMPROVED SILVER BLACKNESS OF PICTURE IMAGE

[75] Inventors: Nobuaki Miyasaka; Hideo Ikeda; Minoru Sakai; Shigeru Ohno; Yasuo Mukunoki, all of Minami-ashigara, Japan

[73] Assignee: Fuji Photo Film Co., Ltd., Minami-ashigara, Japan

[21] Appl. No.: 872,895

[22] Filed: Jun. 11, 1986

[30] Foreign Application Priority Data

Jun. 12, 1985 [JP] Japan ..... 60-127663

[51] Int. Cl.[4] ..... G03C 1/02; G03C 1/08; G03C 7/26

[52] U.S. Cl. ..... 430/567; 430/434; 430/559; 430/562; 430/563; 430/569

[58] Field of Search ..... 430/567, 569, 434, 559, 430/562, 563

[56] References Cited

U.S. PATENT DOCUMENTS

| | | | |
|---|---|---|---|
| 2,996,382 | 8/1961 | Luckey et al. | 430/502 |
| 3,178,282 | 4/1965 | Luckey et al. | 430/434 |
| 3,397,987 | 8/1968 | Luckey et al. | 430/603 |
| 3,607,278 | 9/1971 | Ditzer, Jr. et al. | 430/509 |
| 4,411,986 | 10/1983 | Abbott et al. | 430/502 |
| 4,414,306 | 11/1983 | Wey et al. | 430/567 |
| 4,425,426 | 1/1984 | Abbott et al. | 430/50 |
| 4,434,226 | 2/1984 | Wilgus et al. | 430/567 |
| 4,435,501 | 3/1984 | Maskasky | 430/567 |
| 4,439,520 | 3/1986 | Kofron | 430/567 X |
| 4,628,021 | 12/1986 | Sawada et al. | 430/567 X |

FOREIGN PATENT DOCUMENTS

| | | |
|---|---|---|
| 3526670 | 2/1986 | Fed. Rep. of Germany . |
| 58-108526 | 6/1983 | Japan . |
| 60-158436 | 8/1985 | Japan . |
| 1426277 | 4/1973 | United Kingdom . |

*Primary Examiner*—Mukund J. Shah

*Attorney, Agent, or Firm*—Burns, Doane, Swecker & Mathis

[57] ABSTRACT

This invention provides a silver halide photographic light sensitive material having an improved blackness of image silver, as well as high sensitivity and covering power. The present silver halide photographic light sensitive material includes at least one layer of a silver halide photographic emulsion on at least one side of a support, characterized in that said layer of silver halide photographic emulsion contains fine silver halide grains, or tabular silver halide grains having a grain thickness of 0.4μ or less, and a dye having a maximum absorption wave length of 520 to 580 nm is contained in said layer of silver halide photographic emulsion and/or another layer such that the transmission density of green light is 0.03 or less after the developing treatment of the photographic light sensitive material.

15 Claims, No Drawings

SILVER HALIDE PHOTOGRAPHIC LIGHT SENSITIVE MATERIAL WITH IMPROVED SILVER BLACKNESS OF PICTURE IMAGE

BACKGROUND OF THE INVENTION (1) Field of the Invention

The present invention relates to a silver halide photographic light sensitive material (referred to as "photographic light sensitive material" hereinafter), and particularly to a photographic light sensitive material having and improved blackness of image silver, high sensitivity, and high covering power.

(2) Description of Prior Art

The covering power of a silver halide emulsion is a matter of great concern for emulsion makers, because the amount of silver required to maintain a given optical density by using an emulsion having a high covering power can be decreased. It is disclosed in U.S. Pat. Nos. 2,996,322, 3,178,282, 3,397,987 and 3,607,278, British Pat. No. 1,426,277, etc., that extremely high covering power can be obtained by mixing a surface sensitive emulsion having a high iodine content with an emulsion comprising small-sized grains which are internally fogged, in order to increase the covering power of a silver halide emulsion. It is also disclosed in U.S. Pat. Nos. 4,411,986, 4,434,226, 4,413,053, etc. that the covering power of developed silver can be greatly increased by using a tabular grain emulsion having a high aspect ratio and a small grain thickness. Furthermore, Japanese Patent Laid-Open No. 108,526/1983 discloses that an extremely high sensitivity and a covering power can be obtained by using so-called epitaxial tabular grains in which another silver salt is arranged in particular sites of tabular grains having high aspect ratios and of small thicknesses. It is known that the use of fine grains of a highly sensitive emulsion having a small average grain size, or tabular grains of a highly sensitive emulsion having a small average grain thickness other than those of the abovedescribed emulsion provides high covering power for silver, as compared with those of emulsions, which have a large average grain size and large average grain thickness.

The color tone of developed silver of emulsion grains, which grains provide silver with high covering power, depends, practically without exception, upon the grain size and grain thickness. However, the tone is yellowish and gives an unfavorable impression to the observer of the resulting picture image. This yellowishness is caused by the strong yellowish light produced by the increase in scattering of blue light due to the decrease in size and thickness of the developed silver generated by the decrease in size and thickness of the grains. Such a phenomenon is a serious problem when a fine grain emulsion (for example, an average grain size of 0.4$\mu$ or less) or tabular grain emulsion having a small grain thickness (for example, a grain thickness of 0.4 or less) is used as a silver halide emulsion. In order to resolve such a problem, a tone-regulating agent is generally used for regulating the color tone of the developed silver. For example, a certain kind of mercapto compound may be used for this purpose. However, application of such a conventionally known tone-regulating agent to an emulsion comprising silver halide grains having high sensitivity causes extreme desensitization, and thus, such an emulsion cannot be put into practice. Japanese Patent Laid Open No. 158436/1985 discloses a technique for improving the color tone of a silver image by including a fluorescent brightener in a sensitive material comprising a tabular silver halide grains having a grain size of 5 times or more the grain thickness. This technique is very effective for observation under a reflected light souce, but it is not effective for observation under transmission light, as is described in such an application.

SUMMARY OF THE INVENTION

The present invention was made in order to resolve the above problems.

The object of the present invention is, therefore, to provide a silver halide photographic light sensitive material having an improved silver blackness of a picture image as well as high sensitivity and high covering power.

Other objects of the present invention will be clear from the following descriptions.

According to the present invention, a silver halide photographic light sensitive material is provided, which has at least one layer of a silver halide photographic emulsion on at least one side of a support, and which is characterized in that the layer of silver photographic emulsion contains fine silver halide grains, or tabular silver halide grains having a grain thickness of 0.4 $\mu$ or less, and a dye having a maximum absorption wave length of 520 to 580 nm is contained in the layer of silver halide photographic emulsion and/or another layer so that the transmisson density of green light is 0.03 or less after the developing treatment of the light sensitive material.

Unexpectedly, the present process does not provide the desensitization which is encountered when the afore-mentioned tone-regulating agent is used, rather the present process makes the color tone of developed silver neutral black, without changing the color tone of the image background (unexposed portion).

The use of, for example, a blue-type dye in place of the present dye having a specific wave length can make the tone of the developed silver neutral black. However, in this case the tone of the unexposed portion is tinged with blue, so that such use is not practical. Further, when the present dye having a specific wave length is used in a large amount (more than 0.03 in respect of the transmission density of green light after the developing treatment), the tone of the developed silver is strongly tinged with magenta, so that such use is not suitable.

DETAILED DESCRIPTION OF THE INVENTION

Dye

As the dye to be used in the present invention, there is used a dye which remains in the layer to which the dye is added after the developing treatment and of which maximum absorption wave length is 520 to 580 nm. The dye is preferably those having a maximum absorption wave length of 530 to 570 nm, and more preferably, those having a maximum absorption wave length of 540 to 560 nm. Such a dye may be an anthraquinone dye, an azo dye, an azomethine dye, an oxonol dye, a carbocyanine dye, and a styryl dye. In view of fastness against discoloration, etc., an anthraquinone dye, an azo dye, and an azomethine dye are preferably to be used.

Specific dyes to be used in the present invention are shown below. However, the present invention is not limited to these dyes.
1
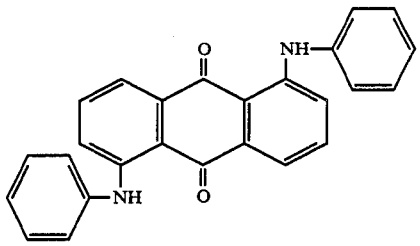
2
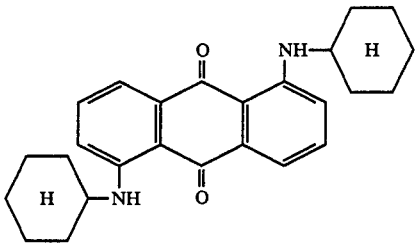
3
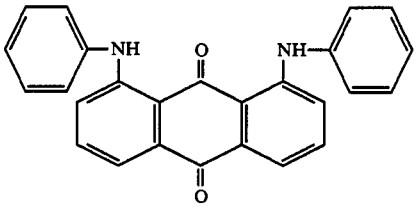
4
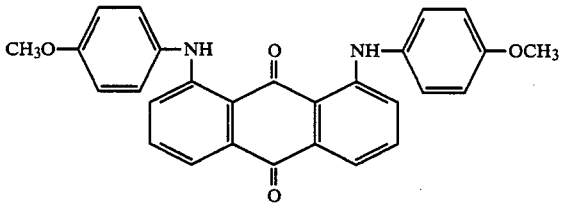
5
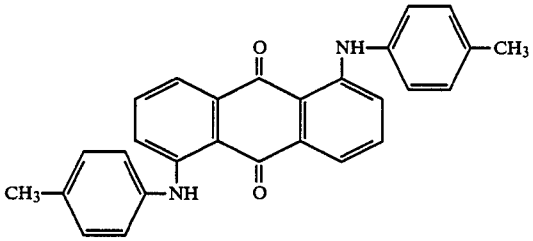
6
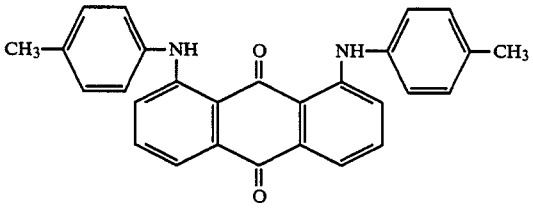

-continued
7
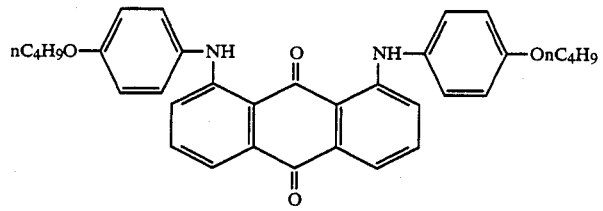
8
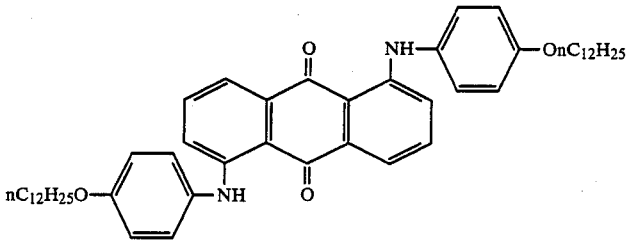
9
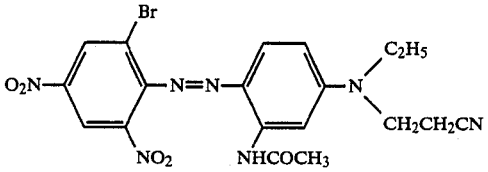
10
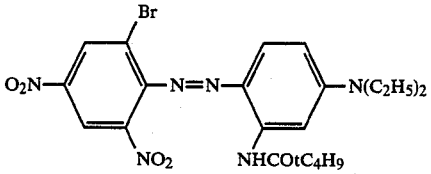
11
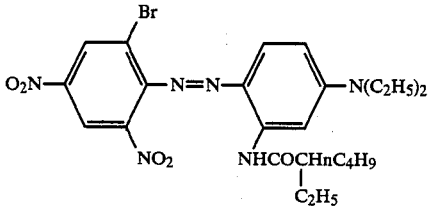
12
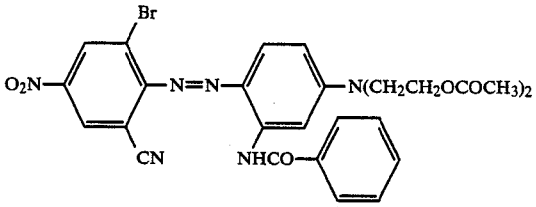
13
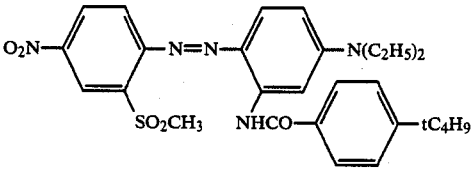
14
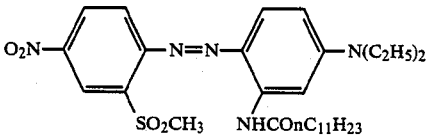

-continued
15
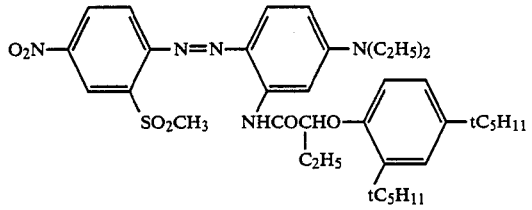
16
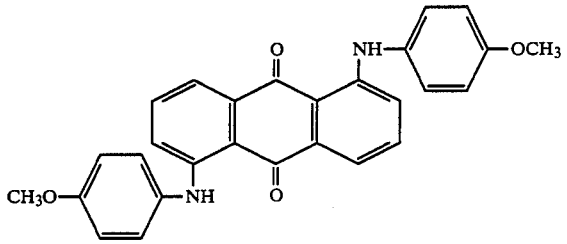
17
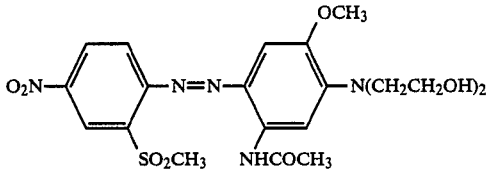
18
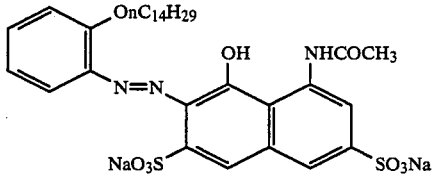
19
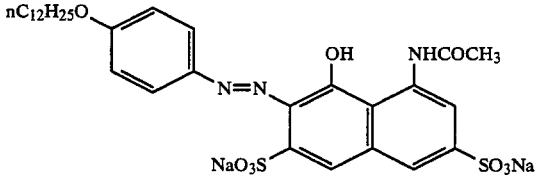
20
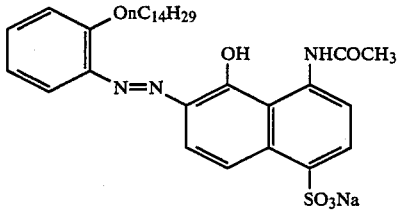
21
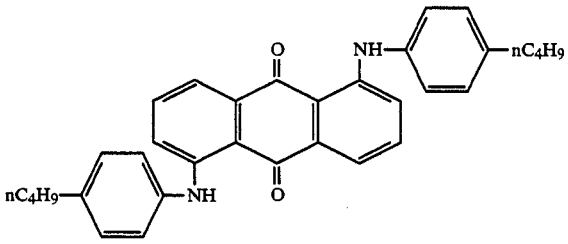

-continued
22
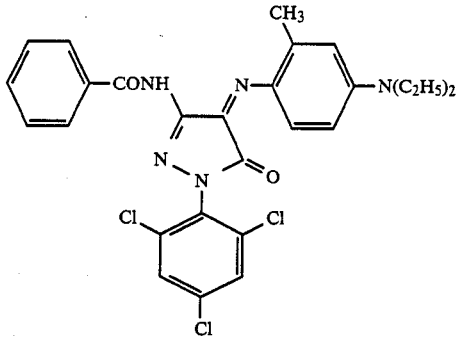
23
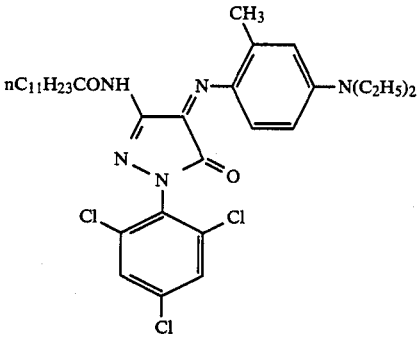
24
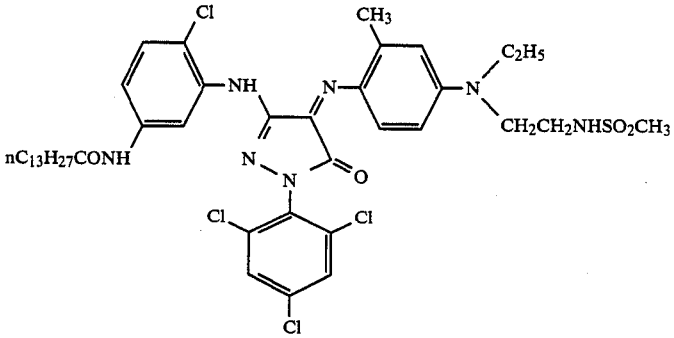
25
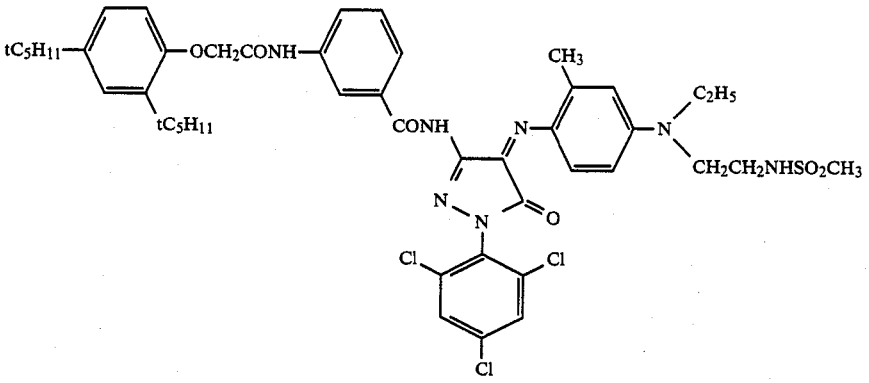

-continued
26
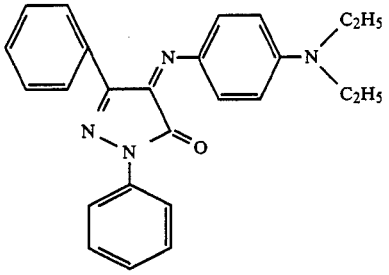
27
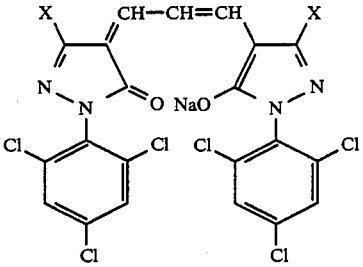
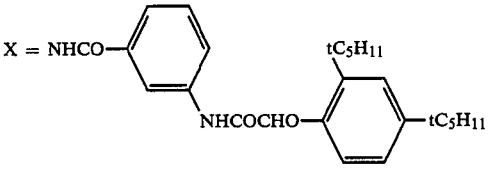
28
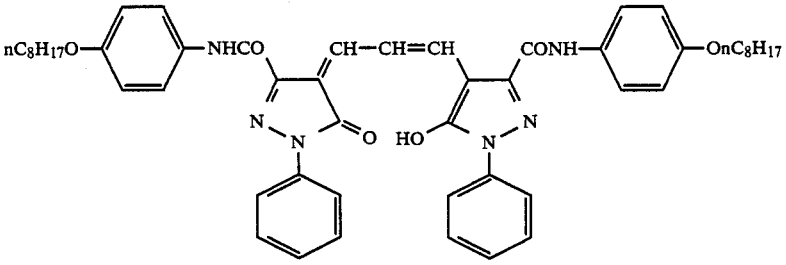
29
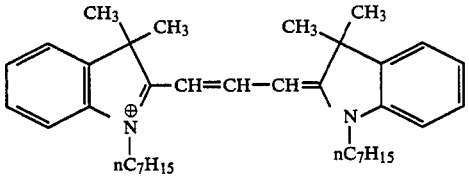
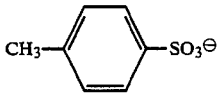
30
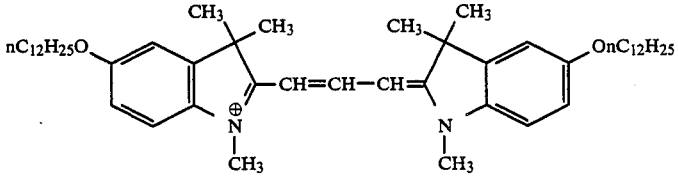
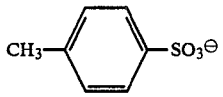

-continued
31
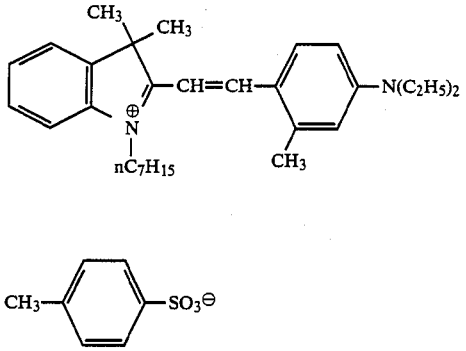
32
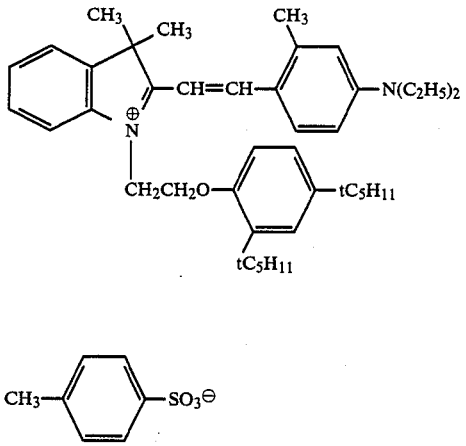
33
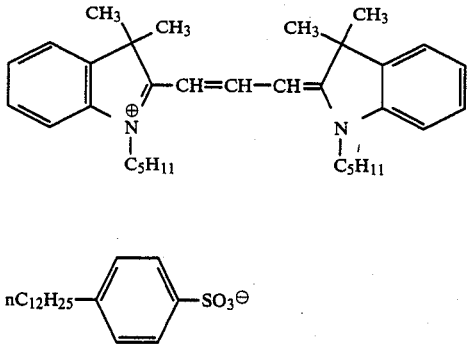
34
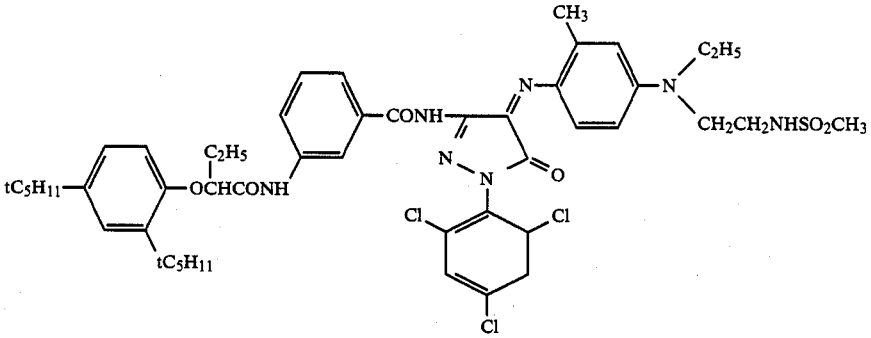

-continued

35

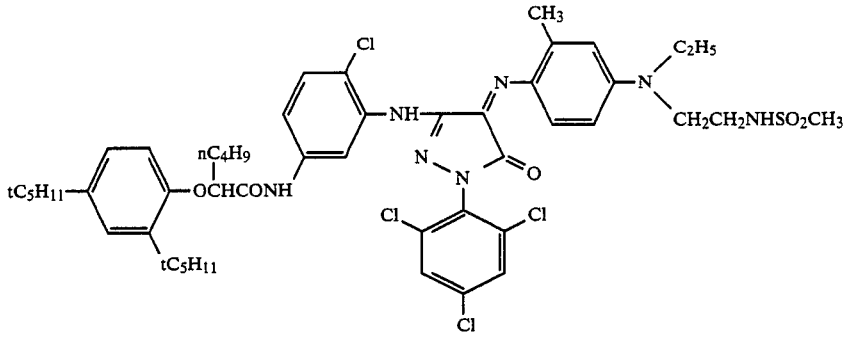

36

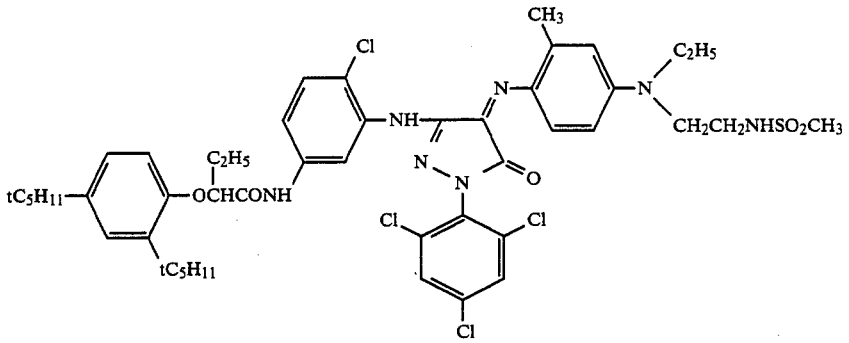

37

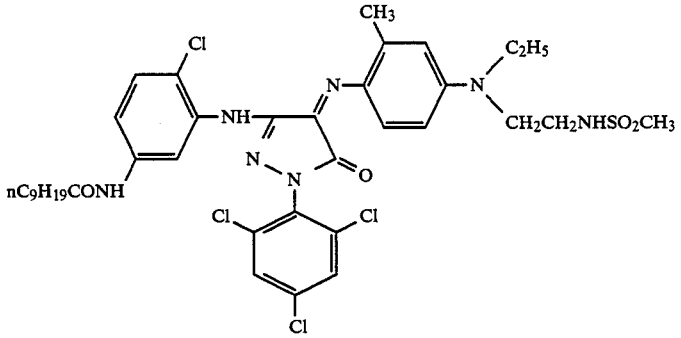

38

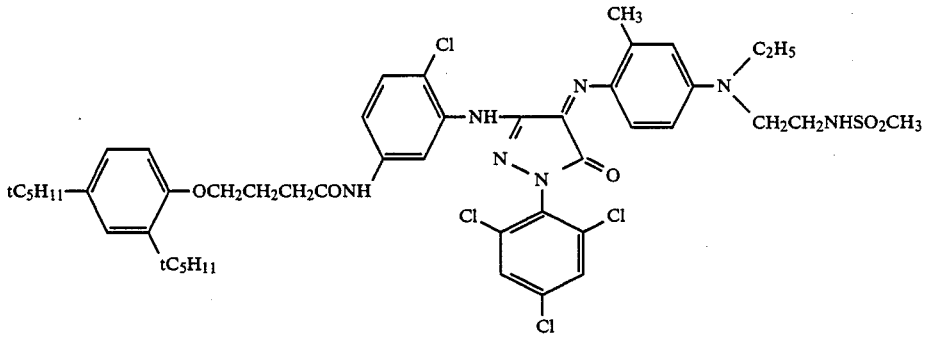

Dispersion of Dye

The dye to be used in the present invention can be dispersed in an emulsion layer and other hydrophilic colloid layers (e.g., an intermediate layer, a protective layer, a anti-halation layer, and a filter layer, etc.) by various known methods such as those described below.

(1) A method of directly dissolving or dispersing the dyes of the present invention in the emulsion layer and the other hydrophilic colloid layers, or dissolving or dispersing the dyes in an aqueous or a solvent and then using the solution or solvent as the emulsion layer and the hydrophilic colloid layers. It is possible to dissolve the dye in a suitable solvent such as methylalcohol, ethylalcohol, propylalcohol, methyl cellsolve, a halogenated alcohol as described in Japanese Patent Laid-Open No. 9715/1973 and U.S. Pat. No. 3,756,830, acetone, water, and pyridine, or a mixed solvent thereof and add the dye to an emulsion solution as its solution form.

(2) A method of obtaining a solution by dissolving the dye in an oil, that is a solvent being substantially insoluble in water and having a high-boiling point of about 160° C. or more, and adding it to a hydrophilic colloid solution, to disperse it. As the high-boiling point solvent, there may be used a phthalic alkyl ester (dibutyl phthalate, dioctyl phthalate, etc.), phosphate (diphenyl phosphate, triphenyl phosphate, tricresyl phosphate, and dioctylbutyl phosphate), citrate (for example, tributyl acetylcitrate), benzoate (for example, octyl benzoate), alkyl amide (for example, diethyl laurylamide), a fatty ester (for example, dibutoxyethyl succinate, and diethyl azelate), trimesate (for example, tributyl trimesate), etc., all of which are described in U.S. Pat. No. 2,322,027. Organic solvents having a boiling point of about 30° C. to about 150° C. can also be used, for example, lower alkyl acetate such as ethyl acetate and butyl acetate, ethyl propionate, sec-butyl alcohol, methylisobutyl ketone, β-ethoxyethyl acetate, methylcellsolve acetate, and solvents easily soluble in water, for example, an alcohol such as methanol and ethanol.

The ratio of the amounts to be used of the dye to the high-boiling point solvent is preferably 10 to 1/10 (weight ratio).

(3) A method of introducing the dye and other additives as a filling polymer latex composition used for a photographic emulsion and other hydrophilic colloid layers.

The above-described polymer latex includes, for example, polyurethane polymer, a polymer polymerized from a vinyl monomer. Suitable vinyl monomers, include acrylates (e.g., methyl acrylate, ethyl acrylate, butyl acrylate, hexyl acrylate, octyl acrylate, dodecyl acrylate, glycidyl acrylate, etc.), α-substituted acrylates (e.g., methyl methacrylate, butyl methacrylate, octyl methacrylate, glycidyl methacrylate, etc.), acrylamides (e.g., butyl acrylamide, hexyl acrylamide, etc.), α-substituted acrylamides (e.g., butyl methacrylamide, dibutyl methacrylamide, etc.), vinyl esters (e.g., vinyl acetate, vinyl butyrate, etc.), vinyl halides (e.g., vinyl chloride, etc.), vinylidene halide (e.g., vinylidene chloride, etc.), vinyl ethers (e.g., vinylmethyl ether, vinyloctyl ether, etc.), styrene, X-substituted styrenes (e.g., α-methyl styrene, etc.), nucleus-substituted styrenes (e.g., hydroxy styrene, chlorostyrene, methyl styrene, etc.), ethylene, propylene, butylene, butadiene, and acrylonitrile. They may be used alone or in a combination of two or more species., or mixed with another vinyl monomer as a minor component. These other vinyl monomers may be itaconic acid, acrylic acid, methacrylic acid, hydroxyalky methacrylate, sulfoalkyl acrylate, sulfoalkyl methacrylate, styrene sulfonic acid, etc.

The filling polymer latex can be produced by any of those methods described in Japanese Patent Publication No. 39853/1976 and Japanese Patent Laid-Open Nos. 59943/1976, 137131/1978, 32552/1979, 107941/1979, 133465/1980, 19043/1981, 19047/1981, 126830/1981, and 149038/1983.

The ratio of amounts to be used of the dye to the polymer latex is preferably 10 to 1/10 (weight ratio).

(4) A method of causing a hydrophilic polymer having a charge opposite to that of the dye ion to coexist as a mordant therewith in a certain layer, so as to localize the dye in the layer by virtue of the interaction of the polymer with the dye molecules.

Such polymer mordants include polymers having secondary and tertiary amino groups, those having nitrogen-containing heterocyclic portions, and those having their quaternary cation group, etc., which polymers have a molecular weight of 5000 or preferably 10000 or more.

For example, such mordants include vinylpyridine polymers and vinylpyridinium cation polymers such as those disclosed in U.S. Pat. No. 2,548,564, etc.; vinylimidazolium cation polymers such as those disclosed in U.S. Pat. No. 4,124,386, etc.; a polymer mordant crosslinkable with gelatin, etc. such as those disclosed in U.S. Pat. No. 3,625,694, etc.; an aqueous sol-type mordant such as those disclosed in U.S. Pat. No. 3,958,995, Japanese Patent Laid-Open No. 115228/1979, etc.; a water-insoluble mordant such as those disclosed in U.S. Pat. No. 3,898,088; a reactive mordant which can form a covalent bond with a dye such as those disclosed in U.S. Pat. No. 4,168,976, etc.; a polymer produced from an ethylene unsaturated compound having a dialkylaminoalkyl ester residue such as those described in British Pat. No. 685,475; a product produced by the reaction between polyvinylalkyl ketone and aminoguanidine such as those described in British Pat. No. 850,281; and a polymer obtained from 2-methyl-1-vinyl imidazole such as those described in U.S. Pat. No. 3,445,231.

(5) A method of dissolving the dye by using a surfactant.

Effective surfactants may be an oligomer or a polymer.

These polymers are described in detail on pages 19 to 27 of the specification of Japanese Patent Laid Open No. 158437/1986.

(6) A method of using a hydrophilic polymer in place of the high-boiling point solvent as stated in the method (2) above or in combination with it. This method is described, for example, in U.S. Pat. No. 3,619,195 and West German Pat. No. 1,957,467.

(7) A micro-capsule method employing a polymer having a carboxyl group, a sulfonic group, etc. in its side chain, as described in Japanese Patent Laid-Open No. 113434/1984.

In addition, a hydrosol of lipophilic polymer as described in Japanese Publication No. 39835/1976 may be added to the hydrophilic colloid dispersion obtained in the above.

As the hydrophilic colloid, gelatin is representative but any of the other conventionally known substances which can be used for photography may be used.

The content of the dye used in present invention is employed so that the green light transmission density is 0.03 or less after the developing treatment. Further, the amount of the dye to be added, whether it is added to both sides or one side of a support, is preferably $1\times10^{-7}$ mole/m$^2$ to $1\times10^{-4}$ mole/m$^2$, more preferably $2\times10^{-7}$ mole/m$^2$ to $5\times10^{-5}$ mole/m$^2$ and most preferably $5\times10^{-7}$ mole/m$^2$ to $2.5\times10^{-5}$/m$^2$ in terms of the total amount of the dye added per unit area, although the amount depends on the absorbance of the dye.

The content of the dye after the developing treatment is so that the green light transmission density is preferably 0.01 to 0.03, and more preferably 0.01 to 0.02. If the transmission density is beyond 0.03, redness becomes excessive, while if it is under 0.01, the effect is decreased.

Silver Halide Grain

As described above, the present invention is effected by fine silver halide grains, or tabular grains having a small grain thickness. In the former case, the invention is more effective with grains having an average grain size of about 0.4μ or less, preferably about 0.3μ or less, and particularly about 0.2μ or less. In the latter case, it is more effective with grains having a grain thickness of about 0.3μ or less, preferably about 0.2μ or less.

The grain size of the fine silver halide grain is expressed in terms of grain diameter when it is a sphere or approximates to a sphere, and is expressed in terms of the diameter of a notional sphere having the same volume as the grain when it is in the different shape.

The grain thickness of an average grain is expressed by the distance between the two parallel surfaces which compose the grain.

The fine grain photographic emulsion used in the present invention can be prepared by the methods as described in "Chimie et Physique Photographique" by P. Glafkiedes, published by Paul Montel Company, 1967, "Photographic Emulsion Chemistry" by G. F. Duffin, published by The Focal Press, 1966, "Making and Coating Photographic Emulsion" by V. L. Zelikman, et al, published by The Focal Press, 1964, etc.

Any of silver iodobromide, silver idochlorobromide, silver chlorobromide, silver chloride, and silver bromide may be used as a halide.

A mixture of two or more kinds of silver halide emulsions which are separately formed may be used.

In the process of the formation of the silver halide grain or physical ripening thereof, there may be present with the above halide, a certain kind of sensitizing dye (for example, carbocyanine), a mercapto compound (for example, 1-phenyl-5-mercaptotetrazole), a tetrazaindene compound (for example, 5-methyl-7-hydroxy-1,3,4-triazaindolidine, etc. for the purpose of making the grain size small, and an iridium salt or its complex salt, a rhodium salt or its complex salt, an iron salt or its complex salt, etc. for the purpose of regulating the sensitivity.

In addition, an emulsion containing a small-sized and internally fogged silver halide may be used as the fine silver halide grain emulsion to be used in the present invention in combination with a high iodine sensitive emulsion.

As a silver halide emulsion of which halide grain has a fogged nucleus therein (internally fogged silver halide emulsions), there are used, for example, those which provide a transmission fog density of 0.5 or less (excluding the density of the support itself) when a sample of a transparent support coated so that the silver amount is 2 g/m$^2$ is developed with D-19 (a developer specified by Eastman Kodak Co.) at 35° C. for 2 minutes without any exposure, and which provide a transmission fog density of 1.0 or more (excluding the density of the support itself) when the same sample is developed with a developer obtained by adding 0.5 g/l of potassium iodide to D-19 at 35° C. for 2 minutes without any exposure.

The silver halide emulsions having the halide containing an internally fogged nucleus can be prepared by various known methods. For example, there are a method comprising fogging a halide having high internal sensitivity as described in U.S. Pat. No. 2,592,250 by means of light irradiation, as described in U.S. Pat. No. 2,996,382; a method which comprises preparing a core halide having a fogged nucleus by fogging it under conditions of low pAg and high pH values or chemically fogging it with a reducing agent, a gold compound, or a sulfur-containing compound, and depositing a shell halide around the core halide (refer to the core-shell emulsion technique described in U.S. Pat. No. 3,206,313), as described in Japanese Patent Laid-Open No. 215647/1983; and a method comprising fogging both the inside and the surface of a silver halide grain and bleaching the fogged nucleus on the surface with a solution of potassium ferricyanide, etc.

The silver halide having an internally fogged nucleus has an average grain size which is smaller than a sensitive emulsion of high iodine content (for example, a surface latent image-type silver halide emulsion), desirably with an average grain size of 0.3μ or less, more desirably one of 0.2μ or less, and most desirably one of 0.1 μm or less, good results being obtained by them.

Furthermore, silver bromide, silver iodobromide, silver iodochlorobromide, silver chlorobromide, silver chloride, etc. may be used as a silver halide emulsion which is internally fogged.

It is preferable that a heterocyclic compound having a mercapto group is made to be adsorbed on the surface of the silver halide which is internally fogged, because fogging and irregular contamination during the development can be controlled or prevented and because photographic property is not deteriorated with the passage of time. As such mercapto compounds, one shown by the following formula (I) is particularly preferable.

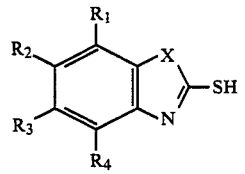

(wherein X denotes —O—, —NH—, or —S—, $R_1$, $R_2$, $R_3$, and $R_4$ denote hydrogen atoms or groups which can substitute the hydrogen, and at least one of $R_1$, $R_2$, $R_3$, and $R_4$ are alkyl or allyl groups of 1 to 13 carbon atoms which are substituted directly or through a divalent connecting group, or are not substituted).

The compounds shown by the formula (I) are described in detail on pages 9 to 18 of the specification of Patent Application No. 170588/1984 corresponding to U.S. Ser. No. 765,238, which can act effectively.

The compounds shown by the formula (I) of the present invention can be used in an amount of $1\times10^{-5}$ to $1\times10^{-1}$ mole per one mole of the internally fogged silver halide grains, and preferably added in an amount of $1\times10^{-4}$ to $1\times10^{-2}$ mole. It is most desirable that the amount to be added is near the saturated adsorption amount as to the surface of the internally fogged grain. The compound may be added by directly dispersing it in a hydrophilic colloid or dissolving it in an organic solvent such as methanol or ethyleneglycol.

Furthermore, when the internally fogged silver halide and the sensitive halide are contained in the same emulsion layer, it is preferable that the compound of the formula (I) is added and made to be adsorbed to the fogged silver halide before they are mixed with each other.

In the present invention, the term "sensitive" means that the sensitivity of the sensitive silver halide is higher than the internally fogged silver halide. More specifically, it means that the former has a sensitivity of 10 times or more, preferably 100 times or more, the latter.

The sensitivity described above is defined in the same manner as the sensitivity described above.

A conventional silver halide emulsion such as a surface latent image-type emulsion is used as the sensitive silver halide emulsion.

This surface latent image-type silver halide emulsion is one in which, when developed after exposure for 1 to 1/100 sec. by method (A) relating to surface development and by method (B) relating to internal development, as described hereinafter, the sensitivity obtained by method (A) is higher than that obtained by method (B), the sensitivity of the former preferably being 2 times or more that of the latter. The sensitivity is defined as follows:

$$S=100/E^h$$

wherein S denotes sensitivity and $E^h$ denotes the exposure amount required to obtain the mean density $\frac{1}{2}(D_{max}+D_{min})$ between the maximum density ($D_{max}$) and the minimum density ($D_{min}$).

[Surface Develpment (A)]

The development is conducted at 20° C. for 10 minutes using the developer prepared as follows:

N-methyl-p-aminophenol (hemisulfate): 2.5 g
Ascorbic acid: 10 g
Sodium methaborate tetrahydrate: 35 g
Potassium bromide: 1 g
Water is added so as to make a total volume of 1 l.

[Internal Development (B)]

Bleaching is conducted by a bleaching solution containing 3 g/l of potassium ferricyanide and 0.0126 g/l of phenosafranine at about 20° C. for 10 minutes; washing is conducted for 10 minutes; and development is conducted at 20° C. for 10 minutes in a developer prepared as follows:

N-methyle-p-aminophenol (hemisulfate): 2.5 g
Ascorbic acid: 10 g
Sodium methaborate tetrahydrate: 1 g
Sodium thiosulfate: 3 g
Water is added so as to make a total volume of 1 l.

Silver iodochloride, silver iodobromide, and silver chloroiodobromide may be particularly used as the surface latent image-type silver halides. Silver iodobromide is preferably used. The content of silver iodide is preferably 2 to 30 mol%, and particularly preferably 4 to 10 mol%. Its average grain size is preferably larger than that of the silver halide having the internal fogged nucleus (the internally fogged silver halide emulsion), particularly preferably, 0.6 μm or more. The distribution of the grain size may be either narrow or wide. The silver halide grains in the emulsion may have regular crystal forms such as a cube and an octahedron, irregular crystal forms such a sphere and a plate, or the complex forms thereof. The grains may comprise mixtures of grains having various crystal forms. The fine silver halide grains desirably occupy 20 wt% or more desirably 40 wt% or more of a photographic emulsion layer.

The present tabular grains havng an average grain thickness of 0.4μ or less preferably have a grain diameter of 5 times the grain thickness in view of speed-granulavity relationship and sharpness.

The grain diameter is desirably 5 to 100 times, more desirably 5 to 50 times, and most desirably 5 to 30 times the grain thickness. The ratio of the tabular silver halide grains occupying the total projection area of the silver halide grains is 50% or more, preferably 70% or more, and much preferably 85% or more. By using such tabular grains, it is possible to obtain a silver halide photographic emulsion with high spectral sensitivity and excellent high illuminance applicability.

The diameter of the silver halide tabular grain is 0.5 to 10μ, preferably 0.6 to 5.0μ, much preferably 1 to 4μ. The diameter of the silver halide tabular grain described above means the diameter of a circle having the same area as the projection area of the particle.

In the present invention, it is preferable that the silver halide tabular grain has a grain diameter of between 0.6 μm and 5.0 μm, a grain thickness of 0.2 μm or less, and a ratio of average diameter/average thickness of 5μ to 50μ. The silver halide photographic emulsion is much preferable wherein the silver halide grains having a grain diameter of 1.0 μm to 5.0 m and a ratio of diameter/thickness of 8 or more occupy 85% or more of the entire projection area provided by all of the silver halide grains contained in the emulsion.

Any of silver chloride, silver bromide, silver chlorobromide, silver iodobromide, and silver chloroiodobromide may be used as the silver halide tabular grain, but it is preferable that a silver bromide; a silver iodobromide comprising 30 mol% or less of silver iodide; or a silver chloroiodobromide and iodobromide comprising 50 mol% or less of silver chloride and 10 mol% or less of silver iodide. The composition of such a mixed silver halide may be uniform or localized, but is preferably uniform. The distribution of grain size may be either narrow or wide.

The silver halide tabular grain-containing emulsion is described in the reports by Cugnac and Chateau and in "*Photographic Emulsion Chemistry*" by Duffin, published by Focal Press, New York, 1966, p. 66–72, and Photo. J., by A. P. H. Trivelli, W. F. Smith, 80, 285 (1940), and can be easily prepared by referring to the methods described in Japanese Patent Laid-Open Nos. 127,921/1983, 113,927/1983, and 113,928/1983.

For example, silver halide tabular grains can be obtained by forming seed crystals in which tabular grains are contained in an amount of 40 wt.% or more, in an atmosphere of a relatively high pAg such as a pBr of 1.3 or less, and growing the seed crystals thus formed by simultaneously adding silver salt solution and halide solutions, while keeping the pBr constant.

In this grain growing process, it is desirable that the silver salt solution and halide solutions are added so as to produce no new crystal nuclei.

The size of the silver halide tabular grains can be regulated by temperature regulation, selection of the amount and kind of solvent employed, and control of the speeds at which the silver salt and the halide are added during the grain growing.

During the production of the silver halide tabular grains of the present invention, their size and form (the ratio of diameter/thickness, etc.), the grain size distribution, and the grain growing speed can be controlled by using a silver halide solvent at need.

The amount of the solvent used is preferably $10^{-3}$ to 1.0 wt.%, particularly $10^{-2}$ to $10^{-1}$ wt.%. For example, the growing speed can be increased by mono-dispersing the distribution of grain size, as the amount of the solvent used is increased. There is also a tendency for the grain thickness to increase, as the amount of the solvent used is increased.

Ammonia, thioethers, and thioureas may sometimes be used as the silver halide solvent. With respect to thioethers, it is possible to refer to U.S. Pat. Nos. 3,271,157, 3,790,387, and 3,574,628.

During the formation and physical ripening of the silver halide grains, there can be used a cadmium salt, a zinc salt, a lead salt, a thallium salt, an iridium salt or complex salt thereof, a rhodium salt or complex salt thereof, or an iron salt or complex salt thereof.

In the production of the silver halide tabular grains of the present invention, there are preferably used methods of increasing the addition speeds, the amounts to be added, and the concentrations of the silver salt solution (for example, an $AgNO_3$ solution) and halide solution (for example, a KBr solution) which are added for the purpose of increasing the grain growth.

With respect to these methods, it is possible to refer to the descriptions of British Pat. No. 1,335,925, U.S. Pat. Nos. 3,672,900, 3,650,757, 4,242,445, and Japanese Patent Laid-Open Nos. 142329/1980 and 158124/1980.

The silver halide grains, the fine silver halide grains, and the high-iodine sensitive tabular silver halide grains of the present invention can be chemically sensitized at need.

For example, the method described in "*Die Grundlagen der Photographishcen Prozesse mit Silber-halogeniden*" by H. Fieser, published by Akademische Verlagsgesellschaft, 1968, pp. 675–734 may be used for the chemical sensitization.

Namely, a sulfur sensitization method which employs a sulfur-containing compound capable of reacting with active gelatin and silver (for example, thiosulfate, thioureas, mercapto compounds, or rhodanines); a reduction sensitization method which employs a reducing substance (for example, a tin (II) salt, amines, a hydrazine derivative, formamidine sulfinic acid, or a silane compound): or a noble metal sensitization method which employs a noble metal compound (for example, a gold complex salt, or a complex salt of a metal, such as Pt, Ir, and Pd of Group VIII in the Periodic Table), may be used solely or in combination.

In the mode of the present invention in which an emulsion containing small-sized internally fogged silver halide grains having an average grain size of 0.4$\mu$ or less is employed in combination with a sensitive emulsion, the kind of the sensitive material can be changed depending on its use and contrast of the emulsion used. The ratio of the fogged silver amount in the internally fogged silver halide emulsion to that in the sensitive emulsion is preferably between 99:1 and 20:80, particularly 9:1 to 4:6. The amount of silver applied is preferably 0.5 to 5 g/m$^2$ per one side.

Layer Structure

Several embodiments as shown below can be considered with regard to the layer structure of the photographic material to which the present invention relates.

(1) A structure wherein an emulsion layer comprising the sensitive silver halide and the internally fogged silver halide and a protective layer (an auxiliary layer) are provided on a support in this order.

(2) A structure wherein an emulsion layer comprising the sensitive silver halide is further provided between the emulsion layer and the protective layer (the auxiliary layer) in the structure (1) in order.

(3) A structure wherein an emulsion comprising the internally fogged silver halide, an emulsion layer comprising the sensitive silver halide, and a protective layer (an auxiliary layer) are provided on a support in this order.

These structures may be provided on either one side or both sides of the support.

Furthermore, the auxiliary layer may be provided separately from the protective layer.

Various kinds of hydrophilic colloids may be used as a binder in the photographic light sensitive material of the present invention.

The colloids which may be used for this purpose include hydrophilic colloids used in the field of photography, such as gelatin, colloidal albumin, polysaccharide, a cellulose derivative, and synthetic resins such as a polyvinyl compound containing a polyvinylalchohol derivative and a acrylamide polymer. It is possible to use a hydrophobic colloid, for example, a dispersed polyvinyl compound, particularly one capable of increasing dimensional stability of a photographic material, together with the above hydrophilic colloid. Suitable compounds of this kind include water-insoluble polymers formed by polymerizing vinyl monomers such as alkylacrylate or alkylmethacrylate, acrylic acid, sulfoalkylacrylate, sulfoalkylmethacrylate, etc.

Various compounds can be added to the photographic emulsion described above for the purpose of preventing any decrease in sensitivity and fogging during the production process, preservation, or treatment of the light sensitive material. As such compounds, very many compounds have been already well known, for example, 4-hydroxy-6-methyl-1,3,3a,7-tetrazaindene, 3-methyl-benzothiazole, and 1-phenyl-5-mercapto-tetrazole, as well as many heterocyclic compounds, mercury-containing compounds, mercapto compounds, and metal salts.

Examples of usable compounds are described in "The Theory of the Photographic Process: Third edition" by C. E. K. Mees, T. H. James, published by The Macmillan Company, 1967, and Research Disclosure, Vol. 176, Item No. 17643, pp. 24–25, Paragraph VI (December, 1978), together with original literature thereof.

The protective layer of the silver halide photographic material of the present invention comprises a hydrophilic colloid as described above. The protective layer may be either a single or a double layer. A matting agent and/or a smoothing agent may be added to the emulsion layer or the protective layer, preferably to the protective layer of the silver halide photographic light sensitive material of the present invention. As examples of the matting agent, there are preferably used organic compounds such as water dispersible vinyl polymers, for example, polymethylmethacrylate, or inorganic compounds such as silver halides and strontium barium sulfate, which have a suitable grain diameter (0.3 to 5$\mu$, or two times or more, preferably four times or more, the thickness of the protective layer). The smoothing agent serves to prevent adhesion troubles like the matting agent, and is particularly effective for improvements with respect to frictional properties which relate to camera adaptability during photography or projection of movie films. Specifically, there are preferably used waxes such as fluidized paraffin and esters of a higher fatty acid, poly-fluorized hydrocarbons or their derivatives, and silicones such as polyalkylpolysiloxane, polyallypolysiloxane, polyalkylallylpolysiloxane, or alkylene oxide-added derivatives thereof.

The silver halide photographic light sensitive material of the present invention may be further provided with an anti-halation layer, an intermediate layer, and a filter layer, if necessary.

In the light sensitive material of the present invention, the silver halide photographic emulsion layer and the other hydrophilic colloidal layers can be hardened by a suitable hardener. Such hardener include a vinylsulfonyl compound as described in Japanese Patent Laid-Open Nos. 76025/1978, 76026/1978 and 77619/1978, hardener containing an active halogen, dioxane derivatives, and hydroxypolysaccharide such as hydroxy starch.

It is possible to add other additives to the silver halide photographic emulsion layer, particularly ones which are useful for the photographic emulsion, for example, lubricants, sensitizer and plasiticizers.

The sensitive material of the present invention may contain a water-soluble dye in the hydrophilic colloidal layer as a filter dye, or for the prevention of irradiation and halation, and various other purposes.

Such dyes include oxonole dyes, hemioxonole dyes, styryl dyes, merocyanine dyes, cyanine dyes, and azo dyes. In particular, oxonole dyes, hemioxonole dyes and merocyanine dyes are useful.

In the sensitive material of the present invention, when the hydrophilic colloidal layer contains a dye and an ultraviolet ray absorber, they may be mordanted by a cationic polymer, etc.

The sensitive material of the present invention may contain a surfactant for other purposes. It is possible to use any of a nonionic, an ionic, and an amphoteric surfactant, depending on purpose. For example, polyoxyalkylene derivatives and amphoteric amino acid (including sulfobetaines) may be exemplified.

In the light sensitive material of the present invention, the photographic emulsion may be subjected to spectral sensitization by a sensitizing dye for light having a relatively long wave length, such as blue, green, red, and infrared light. These sensitizing dyes include cyanine dyes, merocyanine dyes, complex cyanine dyes, complex merocyanine dyes, holopolar cyanine dyes, styryl dyes, hemicyanine dyes, oxonole dyes, hemioxonole dyes, etc.

The sensitizing dyes used in the present invention are used in the same concentration as that used in usual negative silver halide emulsions. In particular, it is advantageous to use the sensitizing dyes in such a dye concentration that substantially no decrease in the inherent sensitivity of a silver halide occurs. The sensitizing dye is preferably used in an amount of about $1.0\times10^{-5}$ to about $5\times10^{-4}$ mole, particularly about $4\times10^{-5}$ to $2\times10^{-4}$ mole per 1 mole of a silver halide.

In the photographic light sensitive materials of the present invention, the photographic emulsion layer and other layers are applied on one or both sides of a flexible support generally used for photographic materials. Useful flexible supports include cellulose acetate, cellulose acetate butyrate, polystyrene, films composed of synthetic polyethylene terephthalate, papers coated with or laminated by a baryta layer or α-olefin polymers (for example, polyethylene, polypropylene, ehtylene/butene copolymer), etc.

In the photographic light sensitive materials of the present invention, the photographic emulsion layer and other hydrophilic colloidal layers can be applied on a support or another layer by various known methods. A dip applying method, a roller applying method, a curtain applying method, and a extrusion applying method may be used as application methods.

These photographic additives, supports, and production mehtods are described in the above-described Research Disclosure, 176, pp 22–31.

Applications

The present invention can be applied for all kinds of photographic meterials, such as X-ray photographic materials, litho-type photographic materials, and black and white negative photographic materials.

In addition, the present invention can be applied for diffusion transfer photographic materials used for forming positive image by dissolving undeveloped silver halide and depositing it on an image receiving layer adjacent to the silver halide emulsion layer; color diffusion transfer photographic materials.

Photographic Processing

Any known methods and processing solutions can be employed for the photographic processes of the light sensitive materials of the present inventions such as those described in Research Disclosure, 176, pp 28–30 (RD-17643). Though the processing temperature is generally 18° C. to 50° C., it may be lower than 18° C. or over 50° C.

A developer used in a monochrome photographic process can cover known developing agents. As for these developing agents, dihydroxybenzenes (for example, hydroquinone), 3-pyrazolidones (for example, 1-phenyl-3-pyrazolidone), aminophenoles (for example, N-methyl-p-aminophenol), etc. may be used alone or in combination. In photographic processes, using the light sensitive materials of the present invention, it is possible to conduct photographic processing by using a developer containing imidazoles as a solvent for silver halide, as described in Japanese Patent Laid-Open No. 78535/1982. It is also possible to conduct processing by using a developer containing a silver halide solvent as described in Japanese Patent Laid-Open No. 37643/1983 and an additive such as indazole or triazole. The developer can generally contain other known preservatives, alkaline agents, pH buffers, fogging-prevention agents, etc. and, if required, it may contain dissolving auxiliaries, tone-regulating agents, developing accelerators, surfactants, anti-foaming agents, water softeners, hardener, thickening agent, etc.

Fixers of conventional composition may be used. It is possible to use thiosulfates, thiocyanates, and organic sulfur-containing compounds which are known to be effective as fixers. The fixers may contain water-soluble aluminum salts as a hardener.

The present invention will be described in more detail with reference to examples set forth below. However, it should be understood that the present invention is not limited to these examples.

Example 1

(1) Preparation of a surface light sensitive silver halide emulsion:

An emulsion containing silver iodobromide (AgI=4 mol%) of a thick plate having an average grain diameter of 1.0μ was prepared by simultaneously adding an aqueous silver nitrate solution and an aqueous solution comprising potassium bromide and potassium iodide, to a vessel containing an aqueous solution comprising potassium bromide, potassium iodide, and gelatin, by a conventional ammonia method, washed by a conventional precipitating method, and then subjected to gold-sulfur sensitization using chloroauric acid and sodium thiosulfate. Then, 4-hydroxy-6-methyl-1,3,3a,7-tetrazaindene as a stabilizer was added to the product to obtain light sensitive iodobromide emulsion Ⓐ-1.

(2) Preparation of an internally fogged fine grain emulsion:

An aqueous silver nitrate and a mixed aqueous solution of potassium iodide and sodium chloride were added to a 2 wt.% aqueous gelatin solution under agitation at 55° C. to prepare core grains. The temperature was raised to 75° C. and suitable amounts of sodium hydroxide and silver halide were added to the resultant suspension and ripened for 15 minutes to form fogged nuclei on the core grains. The temperature was lowered to 55° C., acetic acid and potassium bromide were added to the suspension, so that pH and pAg were returned to the original levels, and then an aqueous silver nitrate and a mixed aqueous solution of potassium bromide and potassium chloride were simultaneously added to the suspension, which were then desalted by a conventional aggregation method and again dispersed in an aqueous gelatin solution. Then, a mercapto compound of the following formula was made to be adsorbed to the grains to prepare silver chloroiodobromide emulsion Ⓑ-1.

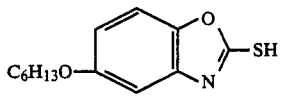

(3) Preparation of a dye emulsion dispersion:

10 g of the dye No. 27 in the dye examples described hereinbefore was weighed and dissolved in a solvent comprising 10 cc of trihexyl phosphate and 50 cc of ethyl acetate, and the solution obtained was subjected to emulsion dispersion in 100 cc of an aqueous 15% gelatin solution containing 500 mg of an anionic surfactant to prepare a dye emulsion A.

5 g samples of the dye Nos. 5 and 6 in the examples described hereinbefore were weighed and dissolved in a solvent comprising 170 cc of tricresyl phosphate and 170 cc of ethyl acetate, and the solution obtained was subjected to emulsion dispersion in 1000 cc of an aqueous 15% gelatin solution containing 3.5 g of an anionic surfactant to prepare a dye emulsion B.

10 g of the dye No. 24 in the examples described hereinbefore was weighed and dissolved in a solvent comprising 10 cc of tricresyl phosphate and 20 cc of ethyl acetate, and the solution obtained was subjected to emulsion dispersion in 100 cc of an aqueous 15% gelatin solution containing 750 mg of an anionic surfactant to prepare a dye emulsion C.

(4) Preparation of an emulsion solution for coating:

5 parts of the emulsion Ⓐ-1 and 1 part of the emulsion Ⓑ-1 were mixed and a sensitizing dye having the absorption peak in the blue light region, 4-hydroxy-6-methyl-1,3,3a,7-tetrazaindene as a stabilizer, dodecylbenzene sulfonate as a coating aid, a polypotassium-p-vinylbenzene sulfonate compound as a thickening agent, a meso-ionic triazolium compound, and the dye emulsion dispersion A, B, and C prepared in (3) were added to the mixture as shown in Table 1.

(5) Preparation of a solution for surface coating for protective layer:

A solution comprising gelatin, polyethylene sulfonate soda as a thickening agent, fine polymethylmethacrylate (an average grain size of 3.0 μm) as a matting agent, N,N'-ethylenebis-(vinylsulfonyl acetoamide) as a hardening agent, sodium t-octylphenoxyethoxyethane sulfonate as a coating aid, and a polyhydroxyethylene surfactant was prepared.

(6) Formation of a coated sample:

The above-described emulsion was coated on both sides of a polyethylene terephthalate support colored blue so that the amount of silver coated was equal to 2.5 g/m² per side, the amount of gelatin from the emulsion was 1.63 g/m² per side, and the amount of gelatin from the solution for a surface coating for protective layer was 1.16 g/m². Thus, each sample had a total amount of gelatin of 2.79 g/m² applied per side.

(7) Photographic sensitometry and tone observation of image silver:

The samples were exposed to blue light of 360–480 m having a strength peak at 414 μm passed through a continuous wedge on the 7th day from the coating, while keeping the temperature at 25° C. and humidity at 65%RH; were then deveoped by using the processing solution described below at the standard developing temperature of 35° C. for 2.5 sec.; were fixed; washed with water, and then dried.

Developer:

Potassium hydroxide: 29.14 g
Glacial acetic acid: 10.96 g
Potassium sulfite: 44.20 g
Sodium bicarbonate: 7.50 g
Boric acid: 1.00 g
Ethylene glycol: 28.96 g
Ethylenediaminetetraacetic acid: 1.67 g
5-Methylbenzotriazole: 0.06 g
5-Nitroimidazole: 0.25 g
Hydroquinone: 30.00 g
1-Phenyl-3-pyrazolidone: 1.50 g
Glutaraldehyde: 4.93 g
Sodium methabisulfite: 12.60 g
Potassium bromide: 7.00 g
Water was added so as to make a total volume of 1 l.
(The pH value was regulated at 10.25.)

Fixing solution:

Ammonium thiosulfate: 200 g
Sodium sulfite (anhydrous): 20 g
Boric acid: 8 g
Disodium ethylenediaminetetraacetate: 0.1 g
Aluminum sulfate: 15 g
Sulfuric acid: 2 g
Glacial acetic acid: 22 g
Water was added so as to make a total volume of 1 l.
(The pH value was regulated at 4.2.)

The results obtained from a photographic sensitometry of the processed photographic materials are shown in Table 1. In the table, the sensitivity values were obtained as logarithms to base ten of reciprocals of the exposure amounts required to obtain a optical density of "fog density+0.3" by transmission light and expressed by values relative to 1.00 in terms of the sensitivity of Sample No. 1.

Samples in which relatively wide areas were uniformly exposed under the above-described standard developing conditions such that the transmission light optical density was about 1.0, and samples which were developed under the same conditions without any exposure, were observed with respect to their tones and the results obtained are also shown in Table 1. The green light transmission density of the non-exposed samples was also measured and the results obtained are shown in Table 1 as the differences in density ($\Delta D_g$) between these samples and samples to which no dye had been added.

TABLE 1

| Sample No. | Dye emulsion Species | Dye emulsion Amount of dye added (both sides) | Relative sensitivity (logarithm) | $\Delta D_G$ of developed sample without exposure | Tone of developed sample without exposure | Tone of developed silver image | Note |
|---|---|---|---|---|---|---|---|
| 1 | — | — | 1.00 | ±0.000 | Blue | Slightly yellowish black | Comparative example |
| 2 | A | $1 \times 10^{-6}$ mole/m$^2$ | " | +0.010 | Blue slightly tinged with magenta | Neutral black | Example |
| 3 | " | $2 \times 10^{-6}$ mole/m$^2$ | " | +0.021 | Blue slightly tinged with magenta | Neutral black | " |
| 4 | B | $2 \times 10^{-5}$ mole/m$^2$ | " | +0.012 | Blue slightly tinged with magenta | Neutral black | " |
| 5 | " | $4 \times 10^{-5}$ mole/m$^2$ | " | +0.020 | Blue slightly tinged with magenta | Neutral black | " |
| 6 | C | $2 \times 10^{-6}$ mole/m$^2$ | " | +0.014 | Blue slightly tinged with magenta | Neutral black | " |
| 7 | " | $4 \times 10^{-6}$ mole/m$^2$ | " | +0.027 | Blue slightly tinged with magenta | Neutral black | " |

As seen from Sample Nos. 2 to 7, it is shown that the tones of the silver images of the samples to which dyes of the present invention were added are improved, without occuring any deterioration of photographic properties as compared with the sample (No. 1) used as the comparative example to which no dye was added.

Example 2

The method of preparing an internally fogged fine grain emulsion of Example 1 was changed as follows:

A silver chloroiodobromide having an average grain size of 0.15μ, in which fogging had previously been produced inside the grains, was prepared by the method described in U.S. Pat. No. 2,592,250 so as to obtain a sensitivity of about 1/100 to 1/500 lower than that of the above-described emulsion, and the same mercapto compound as in Example 1-(2) was then made to be adsorbed onto the grains produced, to yield an internally fogged fine grain emulsion B-2. Example 1 was repeated except for this in completely the same manner as Example 1, and the effects of the dyes were examined, the results being the same as in Example 1.

Example 3

The dye emulsions were added to the surface protective layer in place of the emulsion layer in Examples 1 and 2. In this case, the improved effects of the image silver tones were entirely the same as in Examples 1 and 2.

Example 4

(1) Preparation of a surface light sensitive tabular silver halide emulsion:

To a vessel kept at 72° C. (pAg 0.1; pH 6.5) wherein 30 g of gelatin, 10.5 g of potassium bromide, and 10 cc of an aqueous 0.5 wt.% thioether HO—$(CH_2)_3$—S—$(CH_2)_2$—S—$(CH_2)$—OH were added to 1 l of water, 30 cc of an aqueous 0.88M silver nitrate solution, and 30 cc of an aqueous 0.88M halide solution comprising potassium bromide and potassium iodide in molar ratio of 96:4 and containing 0.075% of the same thioether were simultaneously added over a period of 15 seconds under agitation. Then, 600 cc of an aqueous 1M silver nitrate solution, and 600 cc of an aqueous 1M halide solution comprising potassium bromide and potassium iodide in a molar ratio of 96:4 were simultaneously added to the resulting suspension over a period of 70 minutes, to prepare a tabular silver halide grain emulsion. The obtained tabular silver halide grains had an average diameter of 2.0μ, a ratio of average diameter/average thickness of 16 (the grain thickness was thus 0.125μ), and 4.0 mol% of silver iodide. After desalting followed by chemical sensitization in a combination of a gold and sulfur-sensitization, sodium-3-(5-chloro-2-[2-{5-chloro-3-(3-sulfonatepropyl)-benzoxazoline-2-indenemethyl}-1-butene]-3-benzoxazolio)-propanesulfonate as a sensitizing dye and 4-hydroxy-6-methyl-1,3,3a,7-tetrazaindene were added to the silver halide grains, to obtain a green light sensitive silver iodobromide emulsion Ⓐ-2.

(2) Preparation of a tabular grain emulsion coating solution:

A dodecylbenzene sulfonate as a coating aid, a polypotassium-p-vinylbenzene sulfonate compound as a thickening agent, and the emulsion dispersion of dyes A, B, and C prepared in Example 1-(3) were added to the emulsion obtained in the about (1) as shown in Table 2.

(3) Preparation of a coating solution for surface protective layer and formation of coated samples:

They were the same as Example 1.

(4) Sensitometry and tone observation of image silver:

Example 1 was repeated except that the samples of this example were exposed to green light of 500 to 600 μm having a strength peak at 545 μm through a continuous wedge, or were uniformly exposed.

The results obtained are shown in Table 2.

TABLE 2

| Sample No. | Dye emulsion Species | Dye emulsion Amount of dye added (both sides) | Relative sensitivity (logarithm) | $\Delta D_G$ of developed sample without exposure | Tone of developed sample without exposure | Tone of developed silver image | Note |
|---|---|---|---|---|---|---|---|
| 1 | — | — | 1.00 | ±0.000 | Blue | Yellowish blue | Comparative example |
| 2 | A | $2 \times 10^{-6}$ mole/m$^2$ | 0.98 | +0.020 | Blue slightly tinged with magenta | Neutral black | Example |
| 3 | B | $4 \times 10^{-6}$ mole/m$^2$ | 0.98 | +0.021 | Blue slightly tinged with magenta | Neutral black | " |
| 4 | C | $3 \times 10^{-6}$ mole/m$^2$ | 0.98 | +0.019 | Blue slightly tinged with magenta | Neutral black | " |

As seen from Table 2, it is shown that the tone of the developed silver image of the tabular grain emulsion is greenish black including blue of the base, but that the tone is made neutral black by adding the dyes of the present invention.

Example 5

(1) Preparation of an aqueous surfactant solution of dye:

The dye No. 24 used in Example 1 was dissolved in an aqueous solution of a salt of a compound obtained by butanesulfonating a condensation product of nonylphenol and formalin without the use of a high-boiling point solvent such as trihexyl phosphate of Example 1, and then mixed with an aqueous gelatin solution containing an anionic surfactant, to prepare an aqueous dye solution D.

(2) Formation of a coated sample, sensitometry and tone observation of silver image:

The aqueous dye solution D was added to the same tabular light sensitive grain emulsion coating solution as in Example 4, the resultant solution and the same coating solution for the surface protective layer as in Example 1 were coated on both sides of a support. Sensitometry and tone observation of the silver image were carried out in the same manner as in Example 4. The results show that the tone improving effects of the developed silver image were observed as being the same as Example 3.

As described above, the present invention can provide photographic materials with an extremely improved tone of developed silver image, high sensitivity, and high covering power, which removes one of the disadvantages of a tabular silver halide emulsion and a fine grain emulsion having high covering power of developed silver.

What is claimed is:

1. A silver halide photographic material having at least one layer of a silver halide photographic emulsion on at least one side of a support, wherein said layer of silver halide photographic emulsion contains fine silver halide grains, or tabular silver halide grains having a grain thickness of 0.4μ or less, and wherein a dye having a maximum absorption wave length of 520 to 580 nm is contained in said layer of silver halide photographic emulsion and/or another layer in an amount such that the transmission density of green light is 0.01 to 0.03 after the developing treatment of the photographic material.

2. A silver halide photographic light sensitive material according to claim 1, wherein said dye has a maximum absorption wave length of 530 to 570 nm.

3. A silver halide photographic light sensitive material according to claim 2, wherein said dye has a maximum absorption wave length of 540 to 560 nm.

4. A silver halide photographic light sensitive material according to claim 1, wherein said dye is selected from the group consisting of an anthraquinone dye, an azo dye, an azomethine dye, an oxonol dye, a carbocyanine dye, and a styryl dye.

5. A silver halide photographic light sensitive material according to claim 1, wherein said dye is added to a photographic light sensitive emulsion.

6. A silver halide photographic light sensitive material according to claim 1, wherein said dye is added to a hydrophilic colloid layer.

7. A silver halide photographic light sensitive material according to claim 6, wherein said hydrophilic colloid layer is a protective layer.

8. A silver halide photographic light sensitive material according to claim 1, wherein said dye is contained in said layer in such an amount that the transmission density of green light is 0.01 to 0.02 after the developing treatment of the photographic material.

9. A silver halide photograpic light sensitive material according to claim 1, wherein the average grain size of said fine silver halide grains is 0.4μ or less.

10. A silver halide photographic light sensitive material according to claim 9, wherein the average grain size of said fine silver halide grains is 0.3μ or less.

11. A silver halide photographic light sensitive material according to claim 1, wherein the thickness of said tabular silver halide grains is 0.3μ or less.

12. A silver halide photographic light sensitive material according to claim 1, wherein said fine silver halide grains are internally fogged.

13. A silver halide photographic light sensitive material according to claim 12, wherein said internally fogged fine silver halide grains are used in combination with a light sensitive iodine content-light sensitive material.

14. A silver halide photographic light sensitive material according to claim 1, wherein the diameter of said tabular silver halide grains is 0.5 to 10μ.

15. A silver halide photographic light sensitive material acccording to claim 1, wherein the average diameter/average thickness ratio of said tabular silver halide grains is 5 to 50.

* * * * *